United States Patent [19]

Laberge et al.

[11] Patent Number: 5,007,108

[45] Date of Patent: Apr. 16, 1991

[54] CHEST PROTECTOR

[75] Inventors: Raymond Laberge, St. Luc; Robert Beauregard, L'Acadie, both of Canada

[73] Assignee: Sport Maska Inc., St. Hyacinthe, Canada

[21] Appl. No.: 399,883

[22] Filed: Aug. 29, 1989

[51] Int. Cl.[5] ..... A41D 13/00

[52] U.S. Cl. ..... 2/2; 2/16

[58] Field of Search ..... 2/2, 2.5, 2.1 R, 2.1 A, 2/16, 44, 45, 22, 24

[56] References Cited

U.S. PATENT DOCUMENTS

| | | | |
|---|---|---|---|
| 2,796,208 | 6/1957 | O'Leary et al. | 2/2 |
| 3,061,839 | 11/1962 | Foster | 2/2.5 |
| 4,198,707 | 4/1980 | Haupt et al. . | |
| 4,325,148 | 4/1982 | Libernois . | |
| 4,467,475 | 8/1984 | Gregory et al. | 2/2 |
| 4,507,804 | 4/1985 | Consigny . | |
| 4,577,346 | 3/1986 | Hall | 2/2 |
| 4,590,622 | 5/1986 | Wolfe et al. | 2/2 |
| 4,783,853 | 11/1988 | Zuber . | |

*Primary Examiner*—William A. Cuchlinski, Jr.
*Assistant Examiner*—Daniel G. DePumpo
*Attorney, Agent, or Firm*—Fleit, Jacobson, Cohn, Price, Holman & Stern

[57] ABSTRACT

Sports player protective equipment having a system of protective padding members, and of a scale-type configuration having one section of protective padding overlapping an adjacent section of protective padding. The padding sections overlap one another and include a sliding extension member, the end of which is secured to an approximate midsection of an adjacent padding section so as to allow sliding movement of one padding section relative to an adjacent padding section. This sliding movement allows for expansion, contraction and rotation of the entire arm protective padding, which provides improved freedom of movement with greatly increased capability of bending of an arm. Advantageously, the arm protective padding sections are capable of extension, contraction and rotation with respect to each other without diminishing protective capability. Therefore, a single chest protector fits different sizes of players due to the extension and contraction capabilities of the arms. Further, the arm protector sections are able to compensate for the twisting or rotation of the arms of the player during play. It is also possible for the hands of the player to rotate at least 180° without loss of protection to the arms.

18 Claims, 6 Drawing Sheets

CHEST PROTECTOR

FIELD OF THE INVENTION

The present invention relates to protective equipment for a sports player, in such sports as hockey, football, polo, and lacrosse, for example. Specifically, a chest protector is disclosed which will protect a player from the force of a projectile or being hit by sports equipment.

BACKGROUND OF THE INVENTION

Protective chest equipment has previously been made of a suit in which many pockets are filled with inserted protective equipment such as foam padding, synthetic material or rigid synthetic material elements. An example of such protective equipment for a hockey goalie is available from Vaughn Custom Sports, Model No. VP 1050 Chest Protector.

Variations for the arm portions of goalie protective equipment have included a series of plastic or fiberglass scales which are attached to each other at their ends about a fixed pivot to provide a certain degree of flexibility, however, always in the same plane during bending of an elbow. The disadvantage of this arrangement is that the arm protection portion is a rather rigid type of protection, heavy, and failing to provide ease of flexibility and movement that is oftentimes required by a hockey goalie, such as rotation, extension and contraction of an arm. A similar type of arrangement for protective pants for a hockey player is disclosed in Canadian Industrial Design No. 47333.

SUMMARY OF THE INVENTION

By the present invention, the disadvantages encountered with prior hockey goalie or other sports protective equipment have been overcome with less components and increased flexibility. The hockey goalie or other sports protective equipment of the present invention implements a system of protective padding members having a scale-type configuration of one section of protective padding overlapping an adjacent section. However, protective padding members are not necessarily attached to adjacent padding sections at the ends of both padding sections. Rather, the padding members may include protective padding sections overlapping one another and including a connection between adjacent overlapping padding sections. The end of the connection is secured to an approximate midsection of an adjacent padding member so as to allow sliding movement of one padding member with respect to an adjacent padding member. This sliding movement allows for expansion and contraction of the entire arm protective padding in different directions, which provides improved freedom of movement with greatly increased capability of bending, rotating and extending of an arm over prior equipment.

Advantageously, the arm protective padding sections are capable of extension, contraction and rotation with respect to each other without diminishing protective capability. Therefore, a single chest protector fits different sizes of players due to the extension, contraction and rotation capabilities of the arms. Further, the arm protector sections are able to compensate for the twisting or rotation of the arms of the goalie during play. It is also possible for the hands of the goalie to rotate at least 180° without loss of protection to the arms.

It is therefore an object of the present invention to provide a chest protector with arm portions capable of twisting with an arm and moving with a hand through 180° of rotation.

It is another object of the present invention to provide a chest protector having arm portions arranged in a series of overlapping padding sections with each padding section including a moveable junction element for connection to a midsection of a bottom surface of an adjacent padding section.

It is still yet another object of the present invention to provide a chest protector with an arm portion having at least two overlapping padding sections, each having a pocket for containment of a foam material insert and at least one fabric extension for flexible connection to a adjacent padding section.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
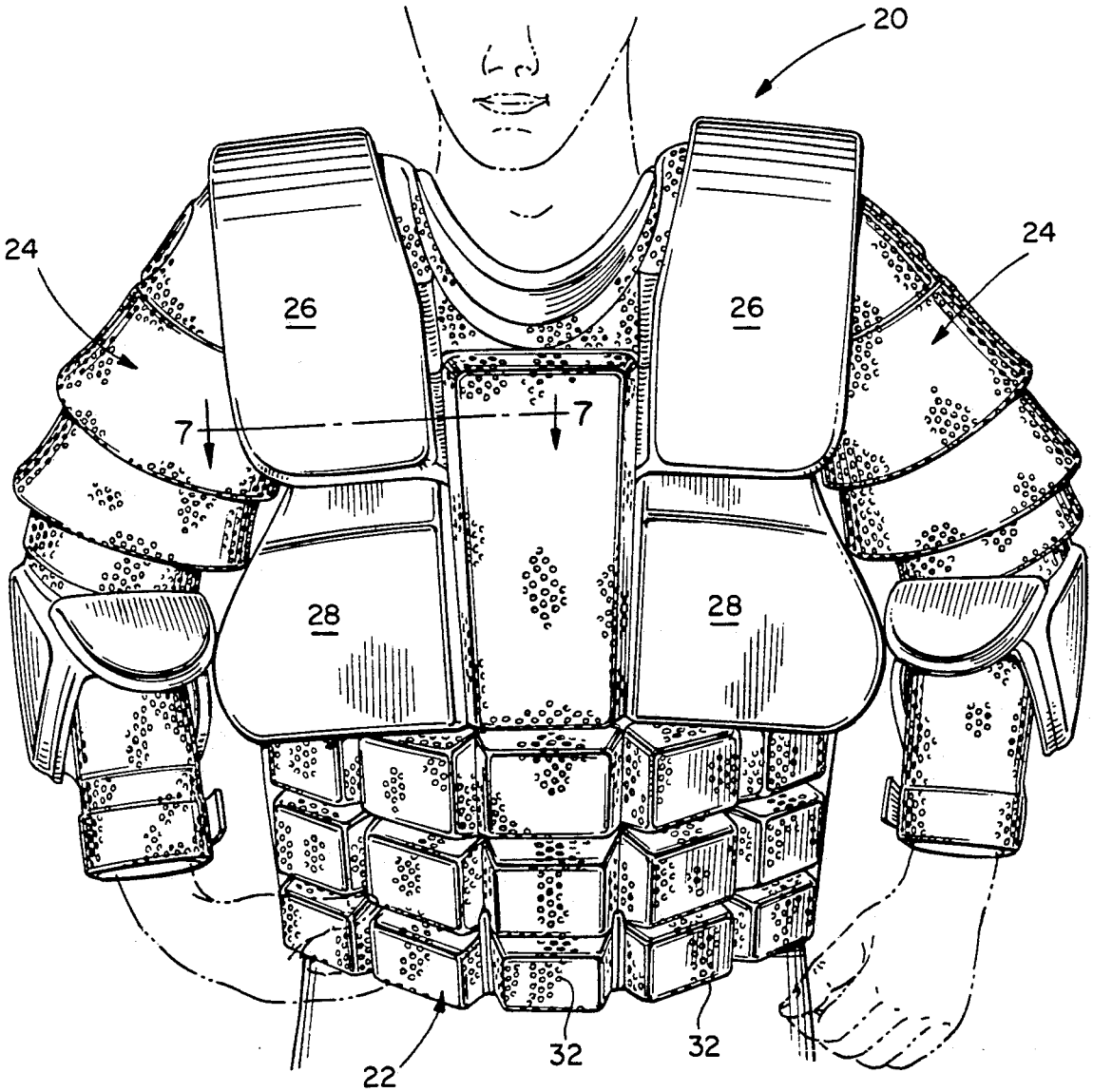
FIG. 1 is a front view of a hockey goalie chest protector.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 to 7, in particular, a chest protector embodying the teachings of the subject invention is generally designated as 20. With reference to its orientation in FIG. 1, the chest protector includes a chest protector section 22 and two arm protector sections 24, which are secured to the chest protector section 22 by lacing or other means such as a VELCRO-type connection, straps or plastic clips, as will be explained with reference to FIGS. 3 and 5. While in a preferred embodiment, the arm protector sections are laced to the chest protector section, the arm protector sections can be unitary with the chest protector section. The arm protector sections 24 may serve as a catching arm and blocking arm protectors for a hockey goalie.

Chest protector section 22 may cover the entire or upper part of the upper torso of a sports player and includes rigid shoulder protector plates 26 and rigid chest protector plates 28 which are encased in fabric. Between the left and right shoulder protector plates and left and right chest protector plates, as well as underneath the shoulder and chest protector plates, are a series of foam insert pads 30 located between two layers of fabric having a series of perforations 32 as is schematically shown in FIG. 1. Alternatively, other homogeneous fabrics without perforations may be used.

Figure 7:
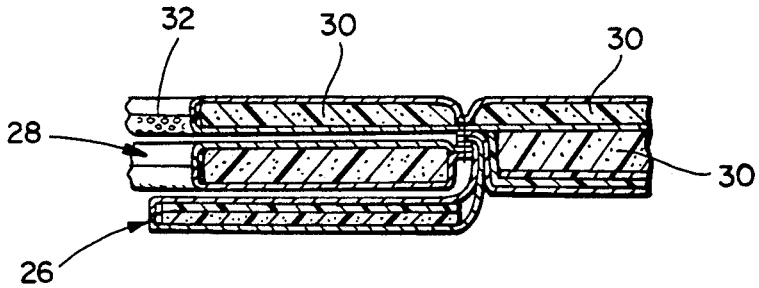
FIG. 7 is a sectional view taken along line 7—7 of FIG. 1.

As shown in FIG. 7, the shoulder protector plate 26 is shown overlaying an upper portion of chest protector plate 28, which both overlay a section of a foam insert pad 30, surrounded by fabric having perforations 32. Adjacent to the shoulder protector plate, and located centrally of the chest protector 20 are additional layers of foam insert pads 30.

Figure 2:
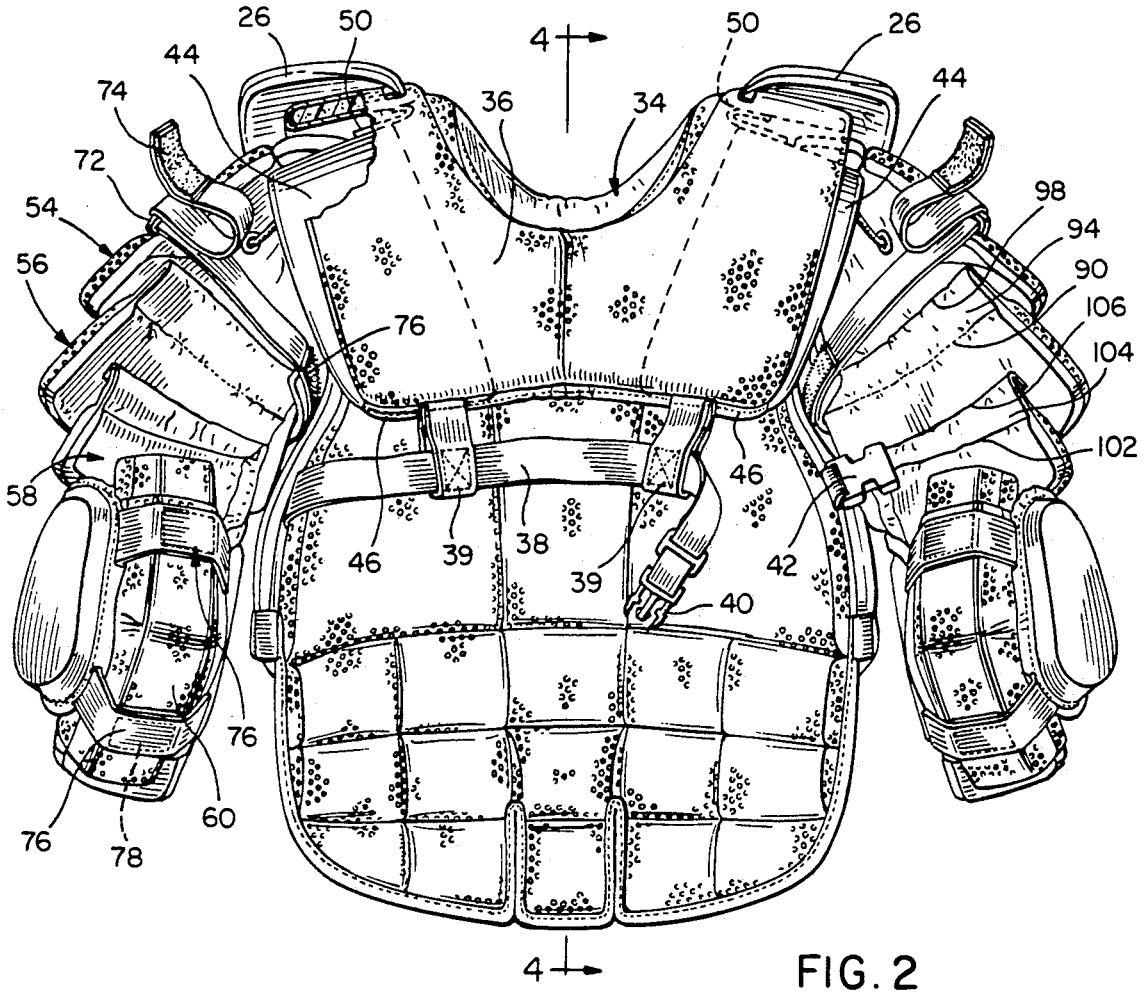
FIG. 2 is a rear view of the hockey goalie chest protector.
Figure 3:
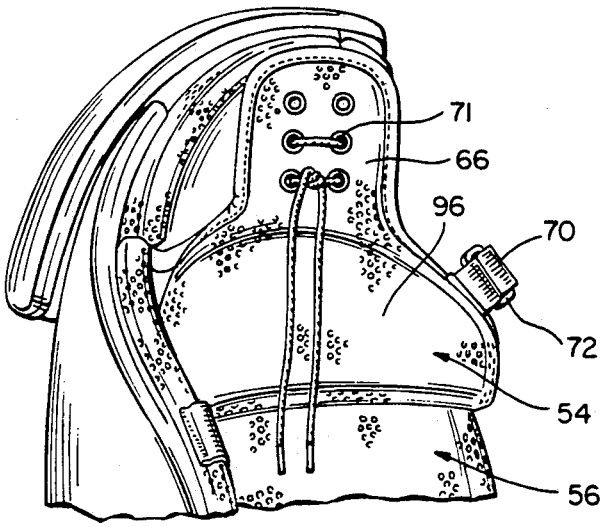
FIG. 3 is a view of an upper portion of an arm protector section connected to a chest protector section of the hockey goalie chest protector.

In FIG. 2, the interior surface of the chest protector 20 is shown. It is understood that the head of the sports player will pass through the opening 34 so as to locate shoulder blade pad 36 on the back of the player across his shoulder blades. The shoulder blade pad 36 is made of a foam insert which is covered in fabric having perforations 32. Belt 38 then passes around the middle of the back of the goalie through loops 39 and is secured by buckle portion 40 within complementary fitting buckle portion 42. The chest protector 20 is thereby secured about the upper torso of the player.

Figure 4:
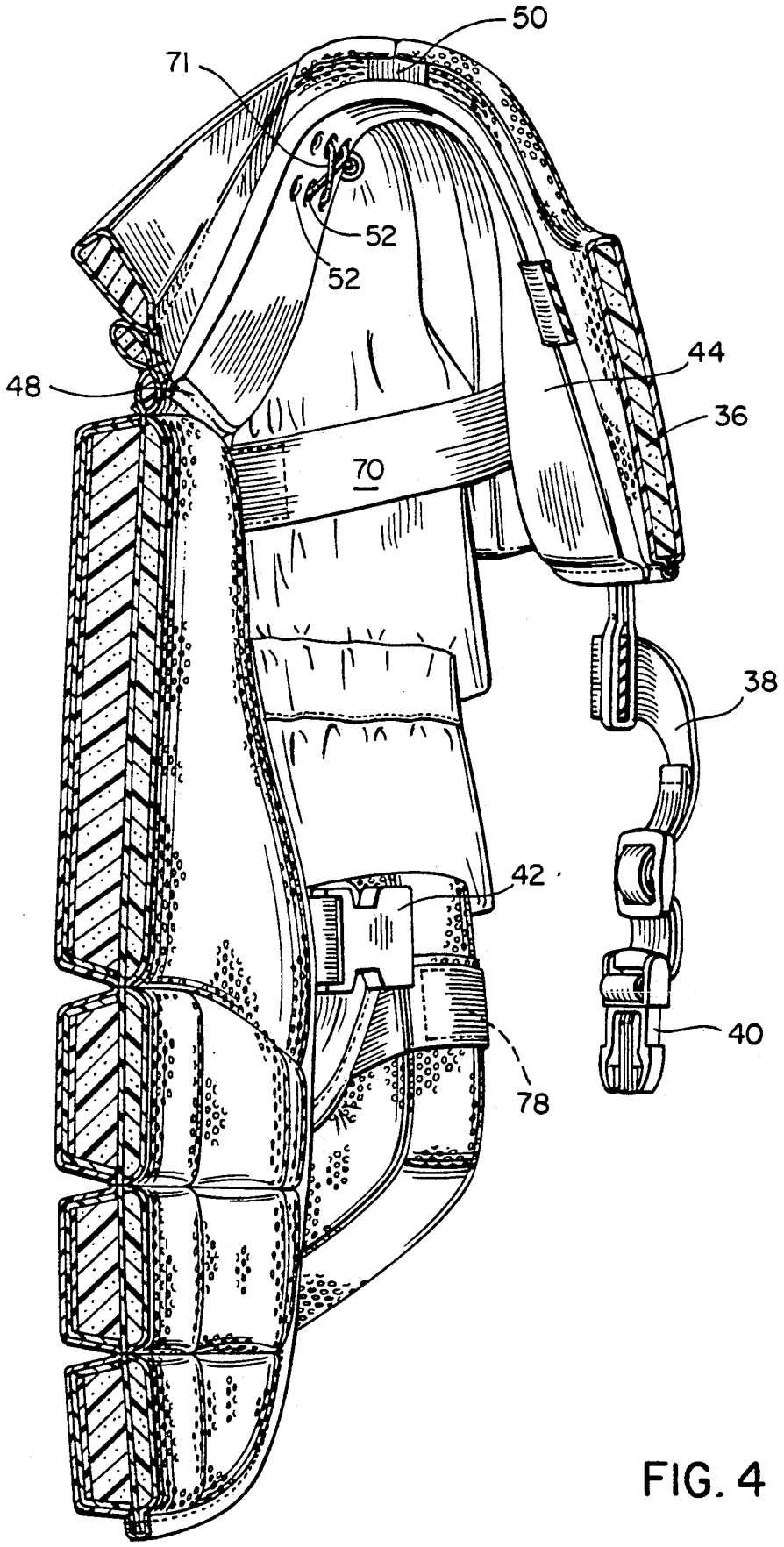
FIG. 4 is a sectional view taken along long 4—4 of FIG. 2.

Extending underneath the shoulder blade pad 36 is a cushioned collar bone pad 44, located on both sides of the chest protector so as to extend in front of the player, across his collar bone, and up across the shoulder to extend down over the shoulder blades of the player. Collar bone pad 44 is stitched to shoulder blade pad 36 along stitch lines 46 at the rear of the chest protector and along stitch lines 48, to a foam insert 30 at the front of the chest protector as shown in FIG. 4.

The pad 44 is connected to the pad 36 at a midpoint of the pad 44, by elastic securing strip 50 which allows movement of the collar bone pad 44 towards and away from the arms of the goalie due to movement of the arms of the goalie and the loose attachment of the arm protector sections 24 to the chest protector section 22. The collar bone pad 44 also includes a series of eyelets 52 for receiving lacing which interconnects the collar bone pad 44 and the arm protector sections. Alternatively, the collar bone pad 44 may be integral with the uppermost padding section of the arm protector section or the collar bone pad may form a padding section joined to a padding section by a coupling as in the connection between the other padding sections.

The arm protector sections will be described with reference to FIGS. 2 through 6. The arm protector sections 24 each comprise at least two padding sections and preferably three overlapping pad sections (upper, intermediate, and lower) 54, 56 and 58, and an elbow pad 60, two side elbow pads 62 and a pad 64 worn on the crook of the arm. It is possible for the arm protector sections to only include three overlapping pad sections made of rigid plastic material in a scale configuration, without any elbow protection. At an uppermost portion 66 of pad 54 are a series of eyelets 68 through which lacing 71 passes, as well as through eyelets 52 of pad 44, for securing the arm protector sections 24 to the chest protector section 22.

Additionally, a strap 70 passes around the rear of the upper portion of the arm and doubles back onto itself after being threaded through a buckle 72, as shown in FIG. 2, for securement of a VELCRO-type hook section 74 to a complementary VELCRO-type pad section 76 so as to secure the arm protector section around the arm of the player. The arm of the player passes between padding 64 and elbow pad 60 for protection of the elbow of the player. The elbow pad 60 is secured to the arm of the player by two elastic strips 76 which are held onto the elbow pad 60 by centrally located VELCRO-type attachment pads 78, shown in phantom lines, in FIGS. 2 and 4.

Extending down the arm, below the elbow pad 60 and pad 64, is padding section 58 which includes two separated foam cushion inserts, namely, a foam cushion insert 80 of portion **58*a* of padding section 58, in addition to the foam cushion insert 82, which is located above the elbow of the arm protector section 24. Alternately, the arm protector section would terminate at the elbow and thereby eliminate insert 80 of portion 58*a***.

Figure 6:
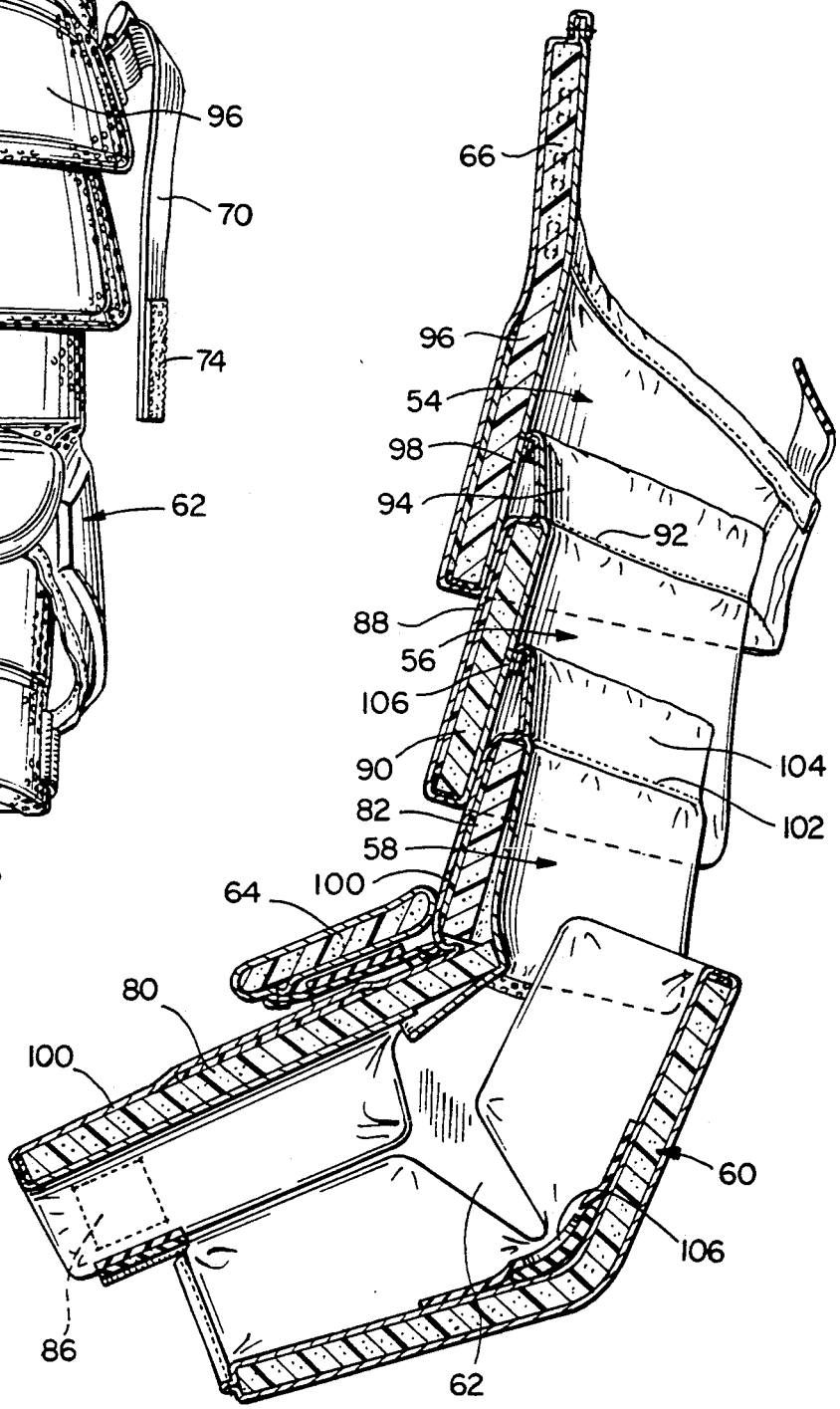
FIG. 6 is a sectional view taken along line 6—6 of FIG. 5.

Padding section 58 in FIG. 6 includes foam inserts 80 and 82 located above and below the elbow to form a unitary assembly with the pads surrounding the elbow so as to move with the movement of the elbow of the player. Any twisting movement of the forearm of the player takes place between foam insert 80 and elbow pad 60 so that the forearm and elbow of the player always remains protected.

At a terminal end of the padding section 58 is a securing strap 84, having a VELCRO-type attachment 86. Strap 84 doubles over the wrist of the player, in a similar arrangement as described for strap 70 having buckle 72 and VELCRO-type securing means 74 and 76, to secure the end of padding section 58 at the wrist of the player.

Of special significance for the padding sections 56 and 58 is their attachment to an adjacent padding section. As shown in FIG. 6, the fabric casing 88, which surrounds foam insert 90 of padding section 56, is secured about the cushion 90 by stitch line 92. A further fabric extension member 94 extends beyond the terminal end of cushion 90 and extends to an approximate midpoint of the main padding section 96 of padding section 54, which is located below extension 66 of padding section 54. Fabric extension 94 is secured to the underside of the padding section 54 by stitch line 98. By this orientation, a portion of the foam insert 90 of padding section 56 lies underneath padding section 54, thereby, foam insert portion 96 of padding section 54 overlaps the foam insert 90 of padding section 56.

By locating a fabric extension below an overlapping padding section, high flexibility is provided for relative movement between the padding sections. Further, one padding section is slidable with respect to an adjacent padding section to allow for extension, contraction and rotation of the arm protector section as the catching and/or blocking arm of a sports player is moved.

Similarly, the upper end of the fabric covering 100 of foam insert 82 of padding section 58 is secured about the foam insert by stitch line 102. Fabric extension 104 of fabric covering 100 is secured underneath foam insert 90 of padding section 56 at an approximate central portion of padding section 56 by stitch line 106. Therefore, foam insert 90 of padding section 56 overlaps foam insert 82 of padding section 58.

Figure 5:
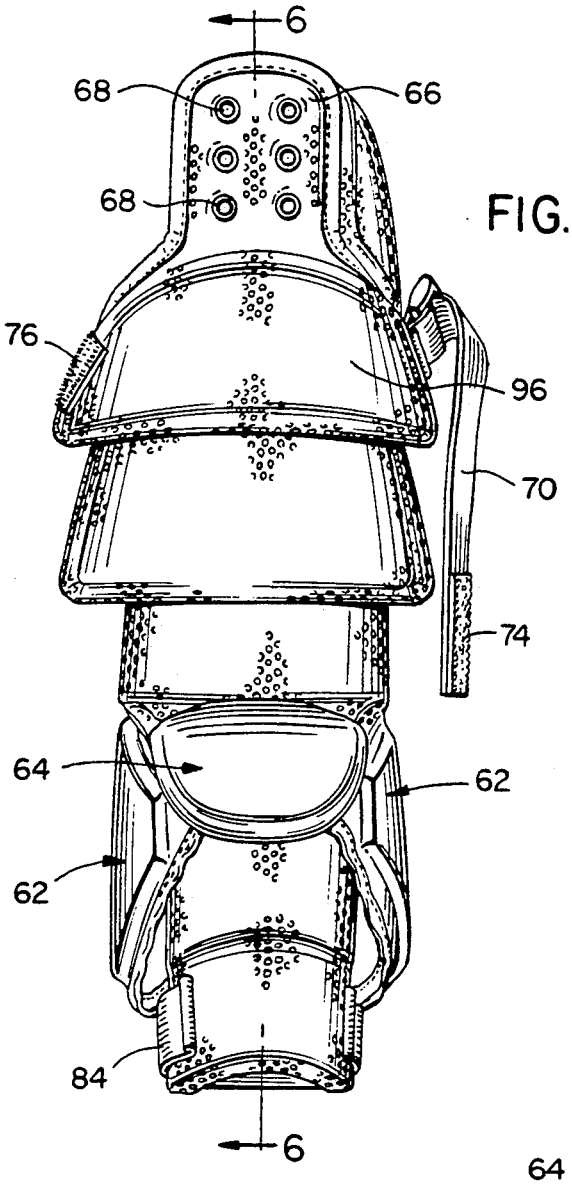
FIG. 5 is a frontal view of the arm protector section.
Figure 11:
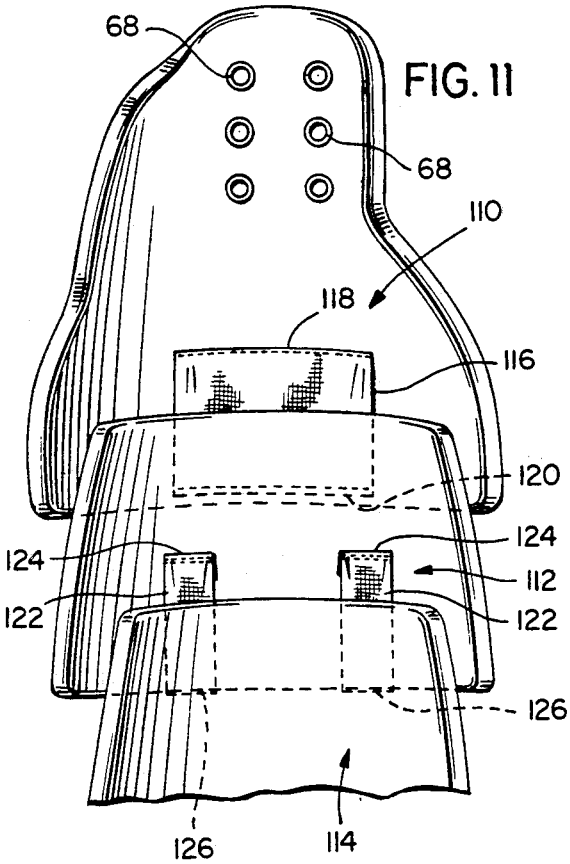
FIGS. 11 through 13 illustrate overlapping padding sections made of rigid plastic and interconnected by alternative connectors for sliding of one padding section relative to an adjacent padding section.
Figure 12:
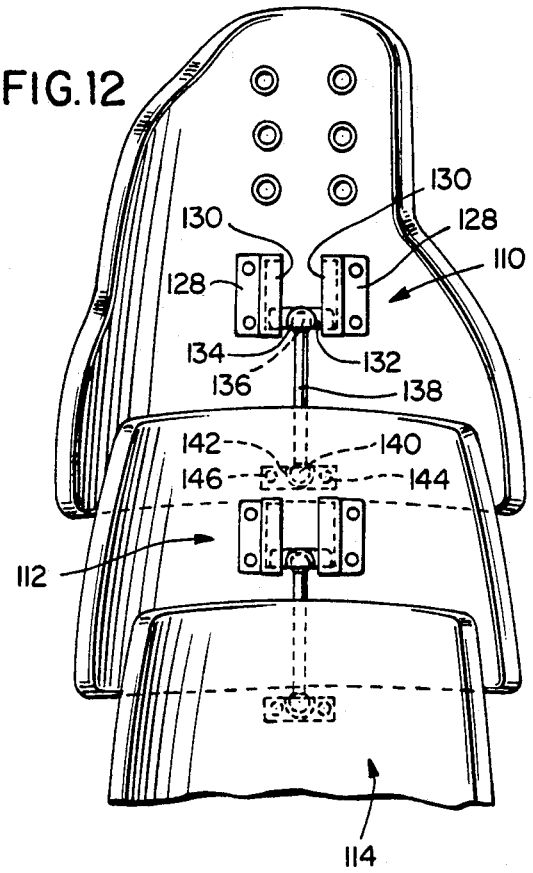
Figure 13:
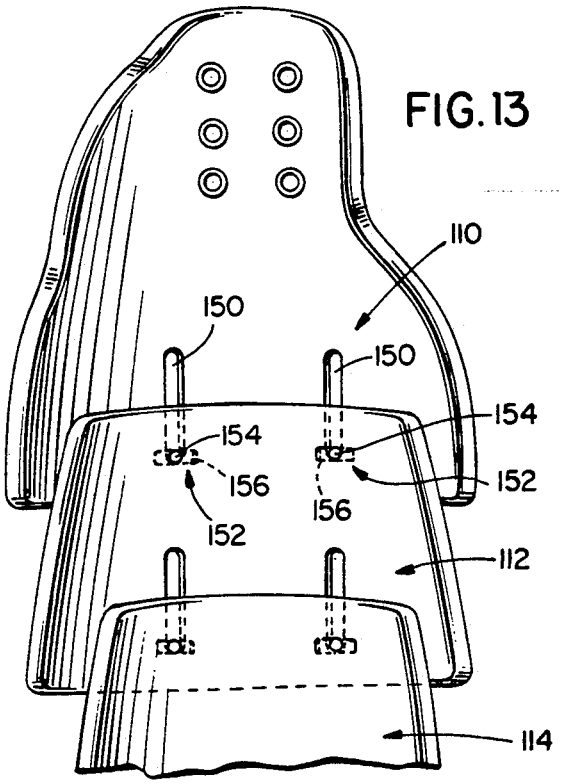

In FIGS. 11 through 13, a plurality of overlapping padding sections 110, 112 and 114 are shown. These padding sections are made of a rigid plastic material and are scale-like in appearance. Since these padding sections are of single piece construction, it is not necessary that these padding sections be covered in fabric. In each of FIGS. 11 through 13, eyelets 68, similar to those shown in FIG. 5, are used for connection of the arm protector sections made up by padding sections 110, 112 and 114 to the chest protector section. As also discussed for FIG. 6, the uppermost padding section 110, as well as the padding section 54 in FIG. 6, may be formed integrally with the chest protector section or secured to the chest protector section by other means.

In FIGS. 11 through 13, alternative connectors between adjacent padding sections are shown for sliding movement of one padding section with respect to an adjacent padding section to allow for contraction, expansion and rotation of the arm protector sections. In FIG. 11, rectangular fabric strip 116 is secured at edge 118 to the underside of the padding section 110. At an opposite end 120, as shown in phantom lines, the fabric strip 116 is secured to an outer surface of adjacent padding section 112. This arrangement may be repeated for the connection between padding sections 112 and 114, however, for the sake of illustration of alternative connecting structures, two fabric strips 122 are shown having an upper edge 124 connected to the underside of padding section 112 and a lower edge 126, shown in phantom lines, connected to an outer surface of padding surface 114. By the connection between the padding sections 110, 112 and 114, by either fabric strip 116 or strips 122, the padding sections are slidably mounted with respect to each other so as to allow extension, contraction and rotation of the arm protector section made up by the padding sections 110, 112, and 114.

The padding sections 110, 112 and 114 may be made of rigid or semi-rigid plastic made of polyethylene, polyurethane or polycarbonate. Alternately, the padding sections may be made of a high density foam such as polyethylene foam having a density of 10 pcf. Also, a fiber reinforced material such as KEVLAR may be used.

In FIG. 12, on the bottom surface of padding section 110 are two spaced brackets 128 defining a groove 130 between the bracket 128 and the padding section 110 for slidably receiving the opposed ends of a slide member 132, having a ball and socket joint 134 for receipt of a ball 136 mounted on one end of a shaft 138. An opposite end 140 of shaft 138 is secured in a ball and socket joint 142 within a plate 144, secured by rivets 146 on an outer surface of adjacent plate 112. An identical connection is shown between padding section 112 and padding section 114.

In FIG. 13, padding section 110 includes two elongated grooves 150. Adjacent padding section 112 includes a T-shaped projection 152 having a shaft 154 and from which a transverse extension 156 extends so as to lock the adjacent padding sections 110 and 112 for sliding movement relative to each other. An identical connection between padding sections 112 and 114 is also shown.

Figure 10:
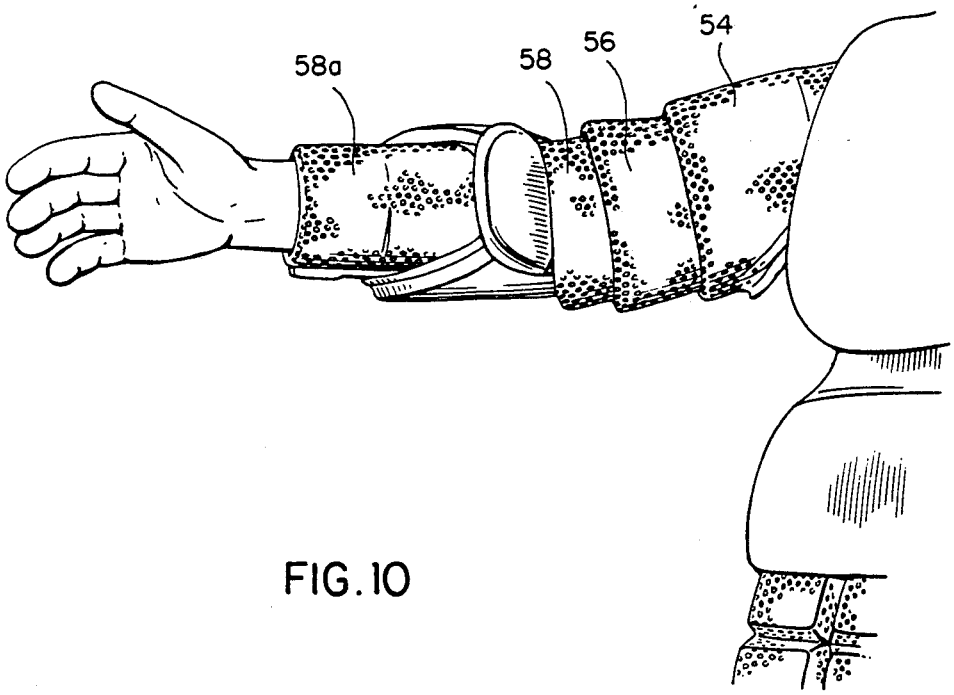

As shown in FIG. 10, the arm of the player may be extended horizontally from his body with the padding sections 54, 56 and 58 extended to their maximum extent by the maximum elongation of the fabric extensions 94 and 104 and the elasticity of elastic extension 50 as tensioned by the movement of the padding section 56 connected to collarbone pad 44 so as to extend away from the shoulder blade pad 36. Tension may be created on the fabric extension sections 94, 104 and the elastic band 50, due to the relative securement of the elbow of the player against cradle 106 in the bend of elbow padding section 60 and the securing of the foam insert 80 of padding section 58 around the wrist of the player by belt 84. The distance between the end of the padding section 58 and the hand of the player as shown in FIG. 10 is intentionally provided for supporting a stick glove used to protect the hand of a hockey goalie's blocking arm and the opposite wrist supporting a cuff of a catch glove of the goalie's catching arm.

Figure 8:
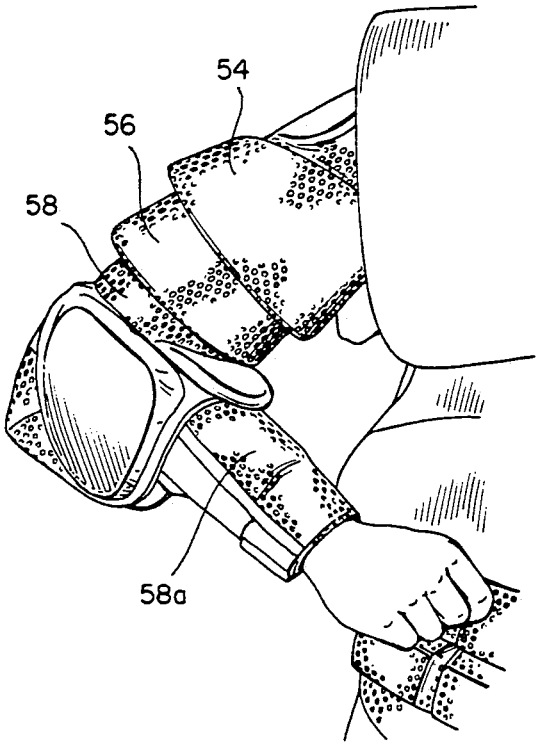
FIGS. 8 through 10 illustrate different positions of the arm protector section moving with the arm of a hockey goalie.
Figure 9:
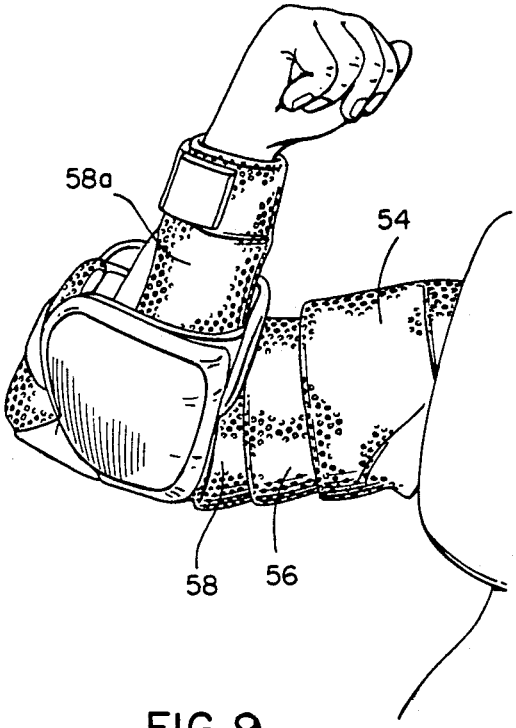

In FIGS. 8 and 9, the freedom of at least 180°, and possibly to 360°, of movement for the forearm of the player is shown with the elbow of the goalie being circumferentially protected while allowing contraction of the padding sections 54 and 56 by compression or gathering of the fabric extensions 94 and 104. During this movement, the foam insert 90 of padding section 56 is allowed to move towards the stitch line 98 of the connection of the fabric extension 94 to the padding section 54 and even allows movement of the pad section 90 past the stitch line 98, if necessary, due to the freedom of movement of the padding section 56 provided by compressible fabric extension 94.

Similarly, compressible fabric extension 104 allows foam insert 90 of padding section 56 to move towards and over the foam insert 82 of the padding section 58 by compression or gathering of the fabric extension 104, so that the padding sections 56 and 58 are slidable with respect to each other and with respect to padding section 54, which is loosely attached to a collar bone padding section 44 by lacing 71 so as to be elastically mounted with respect to the chest protector section 22.

By the present invention, the arm portions of a chest protector for a sports player are extremely flexible to compensate for all degrees of movement of the player by an overlapping of padding sections so as to allow extension and contraction of the padding sections relative to each other. Therefore, a very limited number of sizes of chest protectors, such as for example, three different sizes, will accommodate all different sizes of players.

Having described the invention, many modifications thereto will become apparent to those skilled in the art to which it pertains without deviation from the spirit of the invention as defined by the scope of the appended claims.

We claim:

1. A chest protector for a sports player, said chest protector comprising:

a chest protector section, and two arm protector sections secured at one end to said chest protector section, each of said two arm protector sections including a plurality of padding sections, each having two ends and each having at least one pad member, one of said two ends of at least one padding section being secured to an adjacent padding section centrally, intermediate the ends of the adjacent padding section by moving means for slidably mounting one padding section with respect to an adjacent padding section.

2. A chest protector for a sports player as claimed in claim 1, wherein said arm protector sections include at least three padding sections having a first padding section adapted to be located adjacent an elbow of the player, a second padding section adapted to be located at the upper arm of the player and a third padding section secured at one end to said chest protector section.

3. A chest protector for a sports player as claimed in claim 2, wherein said at least one pad member of said third padding section overlaps said at least one pad member of said second padding section and said at least one pad member of said second padding section overlaps said at least one pad member of said first padding section.

4. A chest protector for a sports player as claimed in claim 2, wherein said moving means of said second padding section is secured underneath said third padding section so that said third padding section overlaps said second padding section and said moving means of said first padding section is secured underneath said second padding section so that said second padding section overlaps said first padding section.

5. A chest protector for a sports player as claimed in claim 4, wherein said at least one pad member of said third padding section overlaps said at least one pad member of said second padding section and said at least one pad member of said second padding section overlaps said at least one pad member of said first padding section.

6. A chest protector for a sports player as claimed in claim 2, wherein said first padding section includes at least two pad members.

7. A chest protector for a sports player as claimed in claim 6, wherein several elbow protector pads are secured to said first padding section.

8. A chest protector for a sports player as claimed in claim 2, wherein fastening means connect said third padding section and said chest protector section.

9. Hockey goalie protective equipment comprising:

a chest protector section adapted to be worn over the upper torso of a hockey goalie, and two arm protector sections adapted to be worn on the arms of a hockey goalie, each of said two arm protector sections including an upper padding section having two ends with one end releasably secured to said chest protector, an intermediate padding section having two ends and being secured at one end to said upper padding section at a location located between said two ends of said upper padding section, and a lower padding section having two ends and being secured at one end at a location located between said two ends of said intermediate padding section, moving means for movably connecting said upper padding section and said intermediate padding section and for movably connecting said intermediate padding section and said lower padding section so that said intermediate padding section is moveable across an upper surface of said lower padding section and moveable across a lower surface of said upper padding section.

10. Hockey goalie protective equipment as claimed in claim 9, wherein each of said padding sections includes at least one pad member with said at least one pad member of said upper padding section overlapping said at least one pad member of said intermediate padding section and said at least one pad member of said intermediate padding section overlapping said at least one pad member of said lower padding section.

11. Hockey goalie protective equipment as claimed in claim 10, wherein said moving means for movably mounting said intermediate padding section and said upper padding section is a flexible extension member and said moving means for movably mounting said lower padding section and said intermediate padding section is a flexible extension member.

12. Hockey goalie protective equipment as claimed in claim 11, wherein said flexible extension member of said intermediate padding section and of said lower padding section includes a portion of a covering for said at least one pad member of said intermediate padding section and a portion of a covering for said at least one pad member of said lower padding section.

13. Hockey goalie protective equipment as claimed in claim 11, wherein said lower padding section includes several elbow protector pads.

14. Hockey goalie protective equipment as claimed in claim 9, wherein fastening means resiliently connect said upper padding section and said chest protector section.

15. A chest protector comprising:

a chest protector section, and two arm protector sections secured to said chest protector sections, said two arm protector sections including a plurality of padding sections, each padding section having two ends and a rigid plate, and moving means for connecting one of said two ends of one padding section to an adjacent padding section centrally, intermediate the ends of the adjacent padding section for slidably mounting said padding sections relative to each adjacent padding section.

16. A chest protector as claimed in claim 15, wherein said moving means includes at least one strip of material.

17. A chest protector for a sports player, said chest protector comprising:

a chest protector section, and two arm protector sections secured at one end to said chest protector section, each of said two arm protector sections including a plurality of padding sections, each having two ends and each having at least one pad member, one of said two ends of at least one padding section being secured to an adjacent padding section by moving means for movably mounting one padding section with respect to an adjacent padding section, said arm protector sections including at least three padding sections having a first padding section adapted to be located adjacent an elbow of the player, a second padding section adapted to be located at the upper arm of the player and a third padding section secured at one end to said chest protector section, said first padding section including at least two pad members.

18. A chest protector for a sports player as claimed in claim 17, wherein several elbow protector pads are secured to said first padding section.

* * * * *